US011155432B2

(12) United States Patent
Shibata et al.

(10) Patent No.: US 11,155,432 B2
(45) Date of Patent: Oct. 26, 2021

(54) SHEET POST-PROCESSING APPARATUS AND IMAGE FORMING SYSTEM INCORPORATING SAME

(71) Applicants: Hidefumi Shibata, Kanagawa (JP); Yohei Yamazaki, Kanagawa (JP); Masanobu Kimata, Kanagawa (JP); Yasuki Matsuura, Kanagawa (JP)

(72) Inventors: Hidefumi Shibata, Kanagawa (JP); Yohei Yamazaki, Kanagawa (JP); Masanobu Kimata, Kanagawa (JP); Yasuki Matsuura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 84 days.

(21) Appl. No.: 16/683,583

(22) Filed: Nov. 14, 2019

(65) Prior Publication Data

US 2020/0231399 A1 Jul. 23, 2020

(30) Foreign Application Priority Data

Jan. 22, 2019 (JP) ..... JP2019-008729

(51) Int. Cl.
*B65H 31/34* (2006.01)
*B65H 43/00* (2006.01)

(52) U.S. Cl.
CPC ..... *B65H 31/34* (2013.01); *B65H 43/00* (2013.01)

(58) Field of Classification Search
CPC ..... B65H 31/02; B65H 31/34; B65H 9/00; B65H 2404/725; B65H 2511/15;
(Continued)

(56) References Cited

U.S. PATENT DOCUMENTS 6,120,020 A * 9/2000 Asao ..... B42C 1/12 270/58.08
6,142,469 A * 11/2000 Nanba ..... B65H 31/10 270/52.03

(Continued)

FOREIGN PATENT DOCUMENTS

CN 1480341 A 3/2004
CN 1524777 A 9/2004

(Continued)

OTHER PUBLICATIONS

Chinese Office Action dated Mar. 30, 2021 issued in corresponding Chinese Application No. 202010025489.3.

*Primary Examiner* — Leslie A Nicholson, III
(74) *Attorney, Agent, or Firm* — Harness Dickey & Pierce, P.L.C.

(57) ABSTRACT

A sheet post-processing apparatus includes an output tray on which a sheet ejected from a sheet outlet is stacked; a wall disposed downstream from the output tray in a sheet ejection direction; and an alignment member configured to contact and move the sheet on the output tray, to bring a rear end of the sheet in the sheet ejection direction into contact with the wall for alignment. The alignment member is selectively set at three positions of: an alignment position protruding beyond the wall toward the output tray to contact the sheet on the output tray; a withdrawn position inward of the wall; and a home position between the alignment position and the withdrawn position.

19 Claims, 13 Drawing Sheets

(58) Field of Classification Search
CPC ..... B65H 2511/152; B65H 2801/27; B65H 2408/1142
USPC ..... 270/58.11, 58.12, 58.17, 58.27; 271/207, 271/220
See application file for complete search history.

(56) References Cited

U.S. PATENT DOCUMENTS 6,412,774 B1 * 7/2002 Saito ..... B42C 1/12 271/220
6,889,974 B2 * 5/2005 Tamura ..... B65H 29/14 271/220
7,007,948 B2 * 3/2006 Kamiya ..... B65H 31/26 270/58.12
7,014,183 B2 * 3/2006 Tamura ..... B42C 1/12 270/58.08
7,182,333 B2 * 2/2007 Tamura ..... B65H 29/14 271/176
7,380,786 B2 * 6/2008 Tamura ..... B65H 29/14 271/207
7,441,771 B2 * 10/2008 Tamura ..... B65H 29/14 271/207
7,451,980 B2 * 11/2008 Tamura ..... B65H 29/14 271/220
7,992,856 B2 * 8/2011 Saito ..... B65H 31/3027 270/58.11
2003/0006543 A1 1/2003 Tamura et al.
2007/0108698 A1 * 5/2007 Tamura ..... B65H 31/10 271/220
2007/0176357 A1 8/2007 Horio et al.
2009/0129840 A1 5/2009 Takekawa et al.
2009/0230613 A1 9/2009 Kuno
2010/0252981 A1 10/2010 Kimata et al.
2011/0190109 A1 8/2011 Kimata
2011/0221125 A1 9/2011 Kimata
2013/0270761 A1 10/2013 Kimata
2016/0355364 A1 12/2016 Shibata et al.

FOREIGN PATENT DOCUMENTS

CN 103662942 A 3/2014
CN 103723552 A 4/2014
JP S63-066034 A 3/1988
JP 2003-002513 1/2003
JP 2004-262595 9/2004
JP 2004256272 A 9/2004
JP 2007-131458 5/2007
JP 2009-203024 9/2009
JP 2009-256097 11/2009
JP 2014-162605 A 9/2014

* cited by examiner

S1
BACK
STAPLING

S1
BACK
SLANT
STAPLING

S1
FRONT
STAPLING

S1
TWO-POINT
STAPLING

SHEET POST-PROCESSING APPARATUS AND IMAGE FORMING SYSTEM INCORPORATING SAME

CROSS-REFERENCE TO RELATED APPLICATION

This patent application is based on and claims priority pursuant to 35 U.S.C. § 119(a) to Japanese Patent Application No. 2019-008729, filed on Jan. 22, 2019, in the Japan Patent Office, the entire disclosure of which is hereby incorporated by reference herein.

BACKGROUND

Technical Field

This disclosure relates to a sheet post-processing apparatus and an image forming system incorporating the sheet post-processing apparatus.

Description of the Related Art

There is known a sheet post-processing apparatus that receives transfer sheets (sheet-like recording media) successively conveyed at regular intervals after image formation and aligns the transfer sheets stacked on an output tray. For example, such a sheet post-processing apparatus has a plurality of sheet ejection modes: a sheet ejection mode for ejecting transfer sheets one by one; and a sheet-bundle ejection mode for ejecting transfer sheets as a bundle. The sheet ejection mode is for, e.g., sorting. The sheet-bundle ejection mode is represented by a staple mode.

Such a sheet post-processing apparatus includes a sheet ejection roller that ejects the transfer sheet onto the output tray, and an alignment member that aligns the transfer sheet ejected on the output tray. The alignment member contacts the transfer sheet on the output tray and moves the transfer sheet in the direction opposite the ejection direction so that an end of the transfer sheet contacts a wall member, thereby aligning the transfer sheet. Due to an inclination of the output tray, the transfer sheet ejected on the output tray by the sheet ejection roller slides down by the weight thereof in the direction opposite the ejection direction, and moves to contact the alignment member.

SUMMARY

According to an embodiment of this disclosure, a sheet post-processing apparatus includes an output tray on which a sheet ejected from a sheet outlet is stacked; a wall disposed upstream from the output tray in a sheet ejection direction; and an alignment member configured to contact and move the sheet on the output tray, to bring a rear end of the sheet in the sheet ejection direction into contact with the wall for alignment. The alignment member is selectively set at three positions of: an alignment position protruding beyond the wall toward the output tray to contact the sheet on the output tray; a withdrawn position inward of the wall; and a home position between the alignment position and the withdrawn position.

According to an embodiment, an image forming system includes an image forming apparatus configured to form an image on a sheet; and the above-described sheet post-processing apparatus, to stack the sheet.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
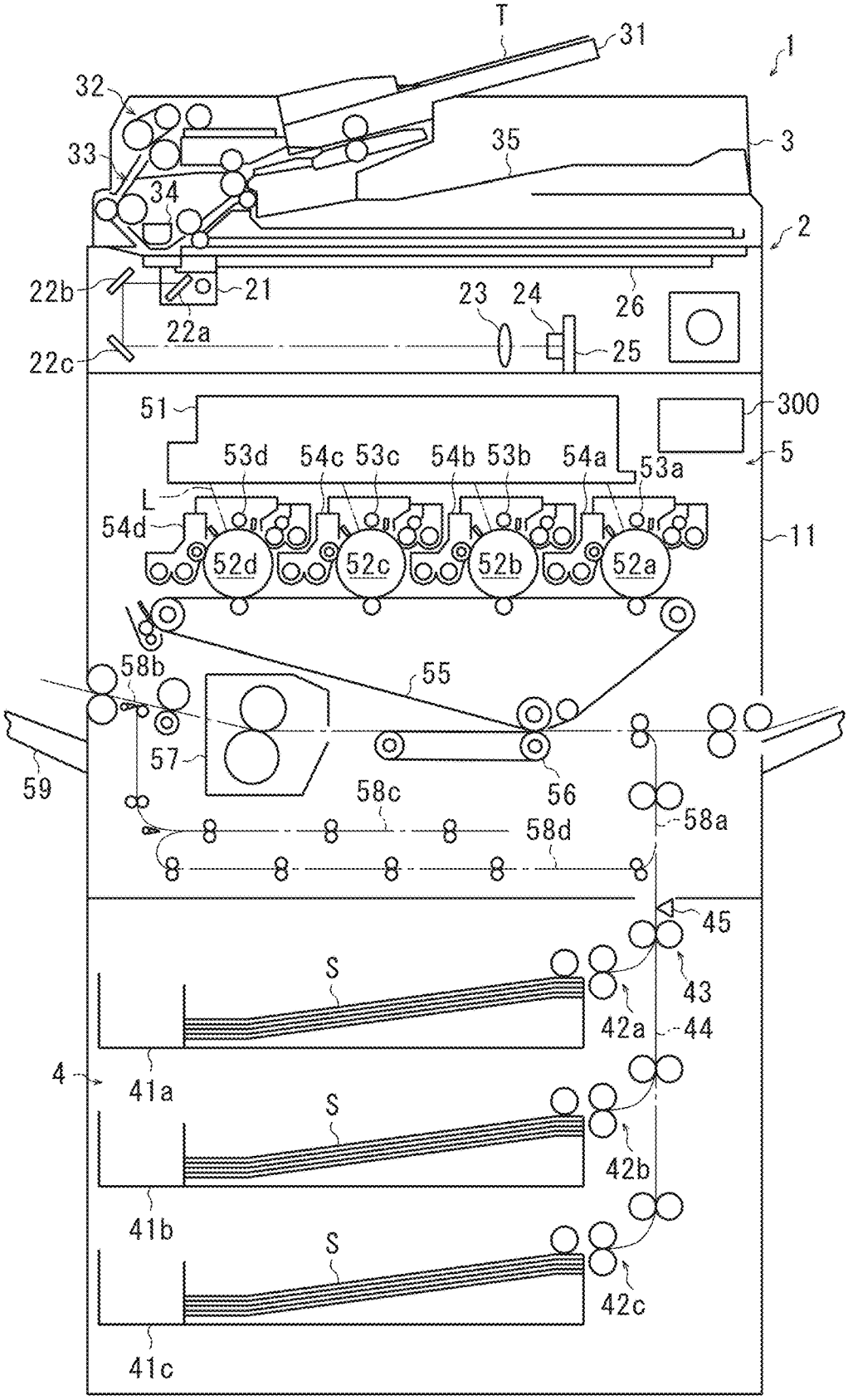
FIG. 1 is a schematic cross-sectional view of an image forming apparatus according to an embodiment of the present disclosure.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, an image forming system according to an embodiment of this disclosure is described. As used herein, the singular forms "a", "an", and "the" are intended to include the plural forms as well, unless the context clearly indicates otherwise.

FIG. 1 is a schematic front view of an image forming apparatus according to an embodiment of the present disclosure. In FIG. 1, a full-color copier 1 (hereinafter referred to as "copier 1") as an image forming apparatus includes a scanner 2 that reads contents of a document T, an automatic document feeder (ADF) 3 that automatically conveys the document T, a sheet feeder 4 that feeds a transfer sheet S as a recording medium or a sheet, and an image forming unit 5 that forms an image on the transfer sheet S. In the present embodiment, the full-color copier 1 using toners of four colors, black (K), cyan (C), magenta (M), yellow and (Y), is described as an example of the image forming apparatus. Alternatively, aspects of this disclosure can adapt to a monochrome image forming apparatus.

The scanner 2 is mounted on the upper side of a housing 11 of the copier 1. The scanner 2 includes a reading device 21 that irradiates the document T with light and reads a document image thereof, a first mirror 22*a*, a second mirror 22*b*, and a third mirror 22*c* that deflect the light reflected from the document T, a lens 23, an imaging device 24 such as a charge-coupled device (CCD), an image processing board 25, and the like. An exposure glass 26 (a platen) on which the document T can be placed is disposed on the upper side of the scanner 2.

The ADF 3 is disposed above the scanner 2. The ADF 3 includes a document table 31 on which the document T is set, a document conveyor 32 including various rollers and drivers, a document conveyance passage 33 through which the document T is conveyed, a reading device 34 that reads an image of the document T conveyed through the document conveyance passage 33 by the document conveyor 32, and a document stacking tray 35 on which the document T from which the image has been read is stacked, and the like.

The sheet feeder 4 includes sheet feeding trays 41*a*, 41*b*, and 41*c* that accommodate the transfer sheets S, feeding members 42*a*, 42*b*, and 42*c* (e.g., roller pairs) that feed the transfer sheets S from corresponding one of the sheet feeding trays 41*a*, 41*b*, and 41*c*, a conveyance member 43 (e.g., a roller pair) that conveys the transfer sheet S fed from each of the sheet feeding trays 41*a*, 41*b*, and 41*c* to the image forming unit 5, and a sheet feeding passage 44 through which the transfer sheet S is fed, and the like.

The image forming unit 5 includes an exposure device 51 that outputs, as an image signal, image information of the document T obtained by the scanner 2 or the ADF 3; and photoconductor drums 52*a*, 52*b*, 52*c*, and 52*d* that carry black (K), cyan (C), magenta (M), and yellow (Y) toner images, respectively. The image forming unit 5 further includes charging devices 53*a*, 53*b*, 53*c*, and 53*d* that charge the photoconductor drums 52*a*, 52*b*, 52*c*, and 52*d*; developing devices 54*a*, 54*b*, 54*c* and 54*d* that form toner images of respective colors on the photoconductor drums 52*a*, 52*b*, 52*c*, and 52*d*; an intermediate transfer belt 55 to which the respective color toner images are primarily transferred from the photoconductor drums 52*a*, 52*b*, 52*c* and 52*d*; and a secondary transfer roller 56 that secondarily transfers the primary transfer images from the intermediate transfer belt 55 onto the transfer sheet S as a full-color toner image. The image forming unit 5 further includes a fixing device 57 that fixes the full-color toner image on the transfer sheet S by heat and pressure; a sheet conveyance passage 58*a* through which the transfer sheet S sent from the sheet feeding passage 44 is conveyed to the fixing device 57; an output tray 59 on which the transfer sheets S bearing the images are stacked; a sheet ejection passage 58*b* through which the transfer sheet S is conveyed from the fixing device 57 to the output tray 59; and a switchback conveyance passage 58*c* and a reversal conveyance passage 58*d* for image formation on both sides of the transfer sheet S.

Next, a series of operations by the copier 1 for image formation of contents of the document T on the transfer sheet S is described.

The document conveyor 32 conveys a document T placed on the document table 31, through the document conveyance passage 33, to a position opposite the reading device 34. The conveyed document T is irradiated with light from a light source of the reading device 21. The reflected light is subjected to photoelectric conversion, based on which the reading device 21 outputs an image signal, representing the image of the surface of the document T, to the exposure device 51. Further, the reflected light of the document T is deflected by the first, second, and third mirrors 22*a*, 22*b*, and 22, and converted into a signal by the lens 23, the imaging device 24, and the image processing board 25.

In the case of single-sided image formation, the document T is conveyed to the document stacking tray 35 by the document conveyor 32, and an image signal is sent to the image forming unit 5. In the case of double-sided image formation, after the scanner 2 outputs image information on one side, the reading device 34 reads information on the other side, and the image information on both sides is output to the exposure device 51.

The ADF 3 is a hinged to the apparatus body of the copier 1 and openable and closable to the apparatus body. When the document T is not automatically conveyed, the ADF 3 is opened, and the document T is placed on the exposure glass 26. In this state, the reading device 21 is driven in accordance with the size of the document T, and reads the image information of the document T.

When the document image information is read and an image signal is output to the exposure device 51, the feeding member 42*a* and the conveyance member 43 convey the transfer sheet S, for example, from the sheet feeding tray 41*a*, to a contact portion between the secondary transfer roller 56 and the intermediate transfer belt 55.

Upon receiving the image signal, the exposure device 51 irradiates the photoconductor drums 52*a*, 52*b*, 52*c*, and 52*d* with the laser light L. In advance, the charging devices 53*a*, 53*b*, 53*c*, and 53*d* charge the surfaces of the photoconductor drums 52*a*, 52*b*, 52*c*, and 52*d* to a predetermined potential. By the irradiation, electrostatic latent images are formed on the photoconductor drums 52*a*, 52*b*, 52*c*, and 52*d*, respectively. Then, the developing devices 54*a*, 54*b*, 54*c*, and 54*d* supply respective color toners to the electrostatic latent images, thereby visualizing the electrostatic latent images as toner images. The visualized color toner images on the photoconductor drums 52*a*, 52*b*, 52*c*, and 52*d* are transferred onto the intermediate transfer belt 55 and superimposed thereon. Thus, a full-color toner image is formed on the intermediate transfer belt 55.

The full-color toner image formed on the intermediate transfer belt 55 is secondarily transferred at a time to the transfer sheet S conveyed at the position opposite the secondary transfer roller 56. Then, the full-color toner image is transferred onto the transfer sheet S. The transfer sheet S on which the full-color toner image is transferred is sent to the fixing device 57, and the full-color toner image is fixed thereon with heat and pressure. The transfer sheet S on which the full-color toner image is fixed is ejected onto the output tray 59 via the sheet ejection passage 58*b*.

The image formation on one side of the transfer sheet S is completed by the series of operations described above. To perform image formation on both sides of the transfer sheet S, after the image formation on one side of the transfer sheet S is completed in the fixing device 57, the transfer sheet S is conveyed to the switchback conveyance passage 58*c* to reverse the direction of conveyance of the transfer sheet S. Thereafter, the transfer sheet S is conveyed to the reversal conveyance passage 58*d* and conveyed again to the position where the intermediate transfer belt 55 opposes the secondary transfer roller 56. After a backside image is formed on the transfer sheet S that has been reversed upside down, the transfer sheet S is ejected onto the output tray 59 via the fixing device 57 and the sheet ejection passage 58*b*.

Figure 2:
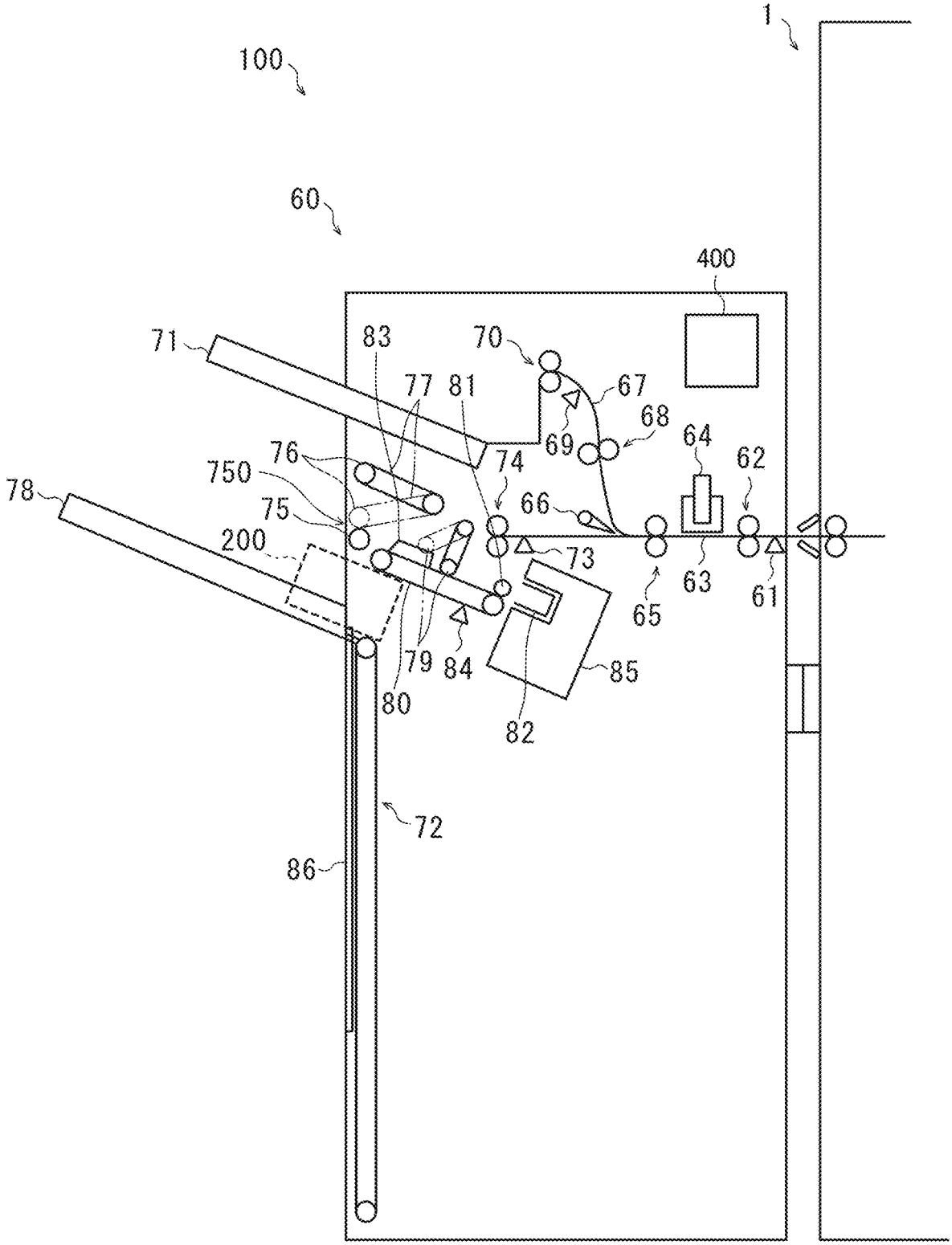
FIG. 2 is a schematic view of a sheet post-processing apparatus according to one embodiment of the present disclosure.
Figure 3A:
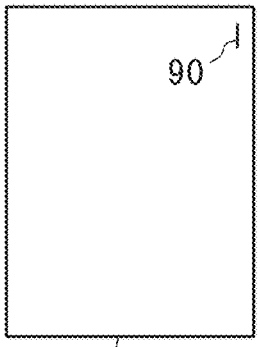
FIGS. 3A to 3D are schematic views illustrating types of stapling performed by the sheet post-processing apparatus used in one embodiment of the present disclosure.
Figure 3B:
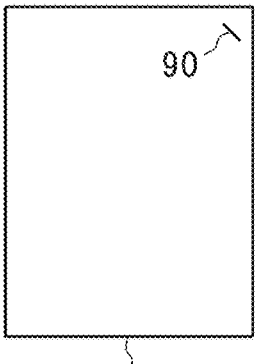
Figure 3C:
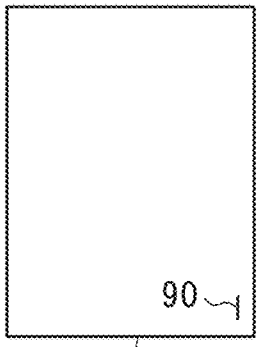
Figure 3D:
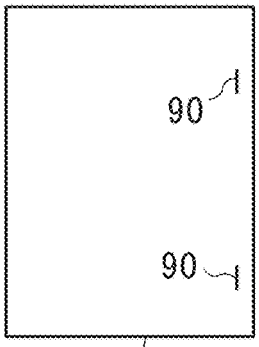

FIG. 2 illustrates a sheet post-processing apparatus 60 to be coupled to the copier 1 according to one embodiment of the present disclosure. The sheet post-processing apparatus 60 performs post-processing of the transfer sheet S on which an image has been formed in the copier 1. The sheet post-processing apparatus 60 has a receiving port that can be coupled to a sheet outlet of the copier 1. The sheet post-processing apparatus 60 can operated in a mode selected from, e.g., a normal mode for simply stacking the transfer sheets S in the order of sheet ejection, a staple mode for stapling the transfer sheets S, a sorting mode for putting together the transfer sheets S for each set of copies, a punch mode for punching the transfer sheet S, and a proof mode different from these modes. The normal mode is a sheet ejection mode in which the transfer sheets S are ejected one by one. The staple mode is a sheet-bundle ejection modes in which a sheet bundle including a plurality of transfer sheets S is ejected. Other modes becomes one of these modes for each job.

In the staple mode, in addition to the size of the transfer sheets S and the number of sheets on which images are formed, the number of sheets bound and the stapling position are designated to perform stapling. These various post-processing instructions are input by keys or the like on a control panel (an operation unit) of the copier 1 and are implemented by exchange of signals between, e.g., a central processing unit (CPU) 300 of the copier 1 and a CPU 400 of the sheet post-processing apparatus 60, which together serve as a controller to control operation of an image forming system 100. The CPU 300 is electrically connected to the CPU 400. The copier 1 can further include a read only memory (ROM), a random access memory (RAM), and the like.

In FIG. 2, the copier 1 and the sheet post-processing apparatus 60 together construct the image forming system 100 that can perform an image forming operation for forming a desired image on the transfer sheet S and a post-processing operation for performing desired post-processing after the image formation.

Next, a configuration and operation of the sheet post-processing apparatus 60 are described.

An entry sensor 61 detects the transfer sheet S ejected from the copier 1, and an entrance roller pair 62 conveys the transfer sheet S through a first conveyance passage 63. When the above-described punch mode is selected, a punch 64 disposed downstream in the sheet conveyance direction from the entrance roller pair 62 is activated, and punching of the transfer sheet S is performed. The transfer sheet S that has passed through the first conveyance passage 63 is conveyed further by a conveyance roller pair 65 disposed downstream from the punch 64 in the sheet conveyance direction. On the downstream side of the conveyance roller pair 65 in the sheet conveyance direction, a first bifurcating claw 66 is disposed. The first bifurcating claw 66 switches the conveyance direction of the transfer sheet S. The first bifurcating claw 66 is displaced by a solenoid to switch the conveyance direction of the transfer sheet S to either a proof tray 71 or an output tray 78. Selection of the discharge destination is designated by operation of the control panel of the copier 1.

To eject the transfer sheet S to the proof tray 71, the first bifurcating claw 66 guides the transfer sheet S to a second conveyance passage 67 disposed above. Then, a proof conveyance roller pair 68 sandwiches and conveys the transfer sheet S. After a proof ejection sensor 69 detects the transfer sheet S, a proof ejection roller pair 70 ejects and stacks the transfer sheet S on the proof tray 71 (proof mode).

To eject the transfer sheet S to the output tray 78, the first bifurcating claw 66 guides the transfer sheet S to the first conveyance passage 63 as is. A sheet sensor 73 to detect conveyance of the sheet S is disposed downstream from the first bifurcating claw 66 and upstream from an intermediate conveyance roller pair 74 to detect passage of the transfer sheet S. After the sheet sensor 73 detects the transfer sheet S, the intermediate conveyance roller pair 74 further conveys the transfer sheet S. The transfer sheet S is sandwiched between a sheet ejection roller 75 and a driven roller 76 rotatably supported by a sheet ejection opening-closing guide plate 77. Then, the transfer sheet S is ejected and stacked on the output tray 78 (normal mode).

When the staple mode is selected, the transfer sheet S conveyed to the intermediate conveyance roller pair 74 is conveyed on a staple tray 80, in contact therewith, by pendulum movements of an alignment roller 79 (a tapping roller) that aligns the transfer sheet S. Then, a return roller 81 conveys the transfer sheet S in the direction opposite to the sheet conveyance direction, so that the rear end thereof contacts a rear end fence 82 (a wall). Thus, the transfer sheet S is aligned in the conveyance direction. On the staple tray 80, a jogger fence 83 for aligning the transfer sheet S in the width direction is disposed. Below the staple tray 80, a sheet sensor 84 to detect the presence or absence of the transfer sheet S on the staple tray 80 is disposed. On the rear end side of the staple tray 80, a stapler 85 that binds a plurality of transfer sheets S is disposed.

Next, an operation for making a predetermined number of transfer sheets S into a sheet bundle is described. The image-formed transfer sheets S are consecutively stacked on the staple tray 80. When the number of transfer sheets S stacked reach a predetermined number, the stapler 85 is actuated with the rear end of the transfer sheets S abutting on the rear end fence 82. The stapler 85 stapes the transfer sheets S with a staple provided therein, into a sheet bundle.

The created sheet bundle is sandwiched between the sheet ejection roller 75 and the driven roller 76 and is ejected and stacked on the output tray 78. At this time, a tray lift 72 moves the output tray 78 up and down. Before the sheet bundle is stacked thereon, the output tray 78 is kept at a position lowered by a predetermined amount. After the sheet bundle is stacked thereon, the output tray 78 is lifted so that a detector detects the upper surface of the sheet bundle. With this structure, the controller controls the respective devices to set the upper surface of the sheet bundle at a predetermined position. An alignment device 200, the description thereof is deferred, pushes the sheet bundle on the top to abut against an end fence 86, which is a wall. Thus, the sheet bundle is aligned in the conveyance direction.

FIGS. 3A to 3D illustrate types of stapling performed on the sheet bundle by the stapler 85 in the stapling mode. In the figures, a sheet bundle S1 including a plurality of transfer sheets S is bound with a staple 90 (a wire piece) by the stapler 85. The stapler 85 can perform stapling on the front side and the back side of the transfer sheet S in the width direction. As illustrated in FIGS. 3A to 3D, the stapler 85 is capable of back stapling, back slant stapling, front stapling, and two-point stapling.

Figure 4:
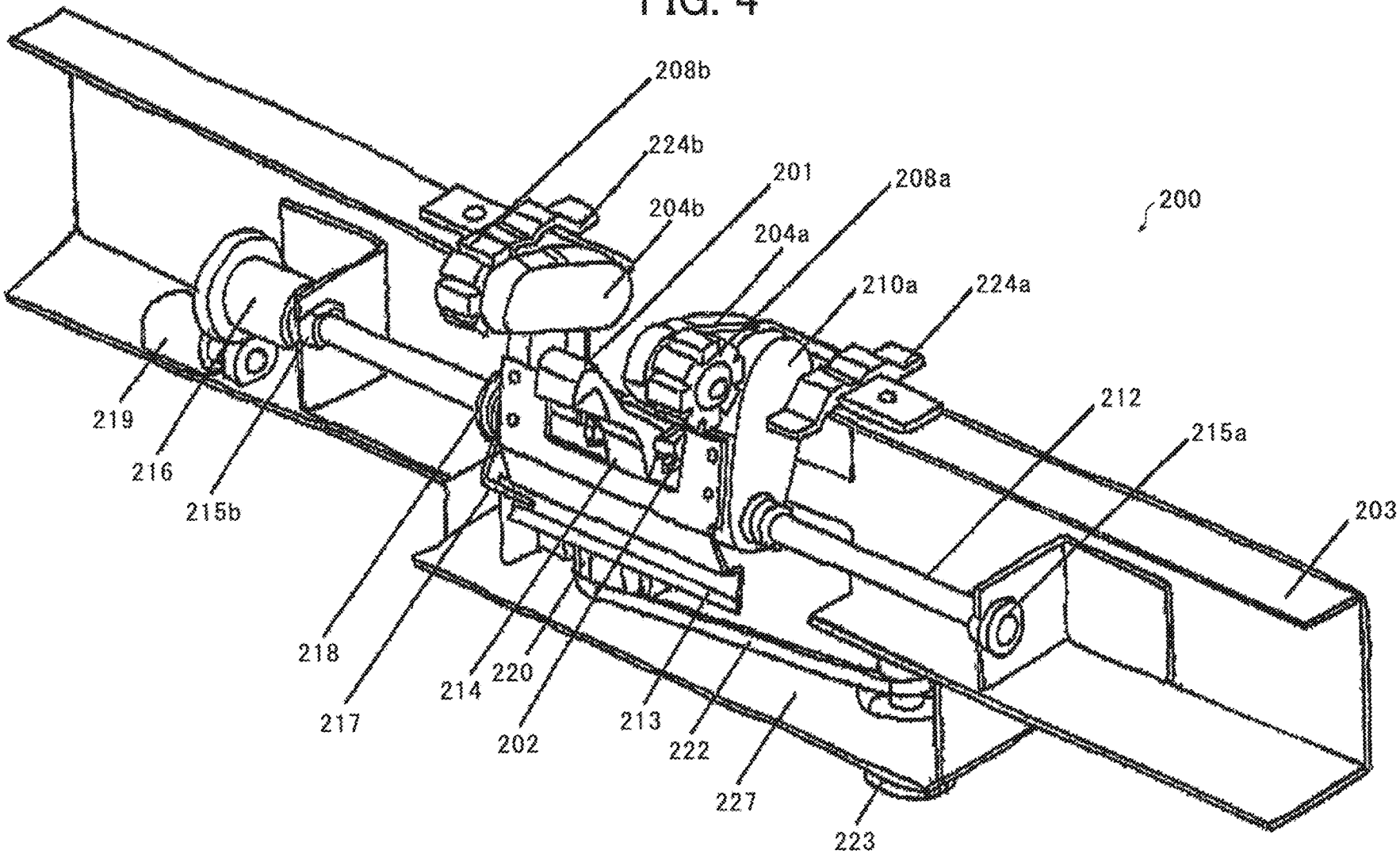
FIG. 4 is a schematic perspective view of an alignment member according to an embodiment of the present disclosure.

Next, the alignment device 200 is described with reference to FIGS. 4 and 5. The alignment device 200 includes return rollers 208*a* and 208*b* as aligning members to contact and move, for alignment, the transfer sheet S or the sheet bundle S1 ejected onto the output tray 78.

First, rotation transmission of the return rollers 208*a* and 208*b* is described. The return roller 208*a*, which is made of, e.g., sponge or resin, is integral with a return roller first timing pulley 205*a*. The return roller 208*a* is rotatably supported by a shaft 204*aa* implanted in a return roller first holder 204*a*. Disposed on a side of the return roller first timing pulley 205*a* is a return roller second timing pulley 206*a*, which is approximately twice as high as the return roller first timing pulley 205*a*. The return roller second timing pulley 206*a* is rotatably supported by a shaft 204*ab* implanted in the return roller first holder 204*a*. A return roller first timing belt 207*a* is stretched around the return roller first timing pulley 205*a* and the return roller second timing pulley 206*a*.

In the vicinity of the return roller 208*a*, a return roller third timing pulley 211*a* attached to a drive shaft 212 is disposed. The drive shaft 212 is inserted into a hole 210*aa* formed in a return roller second holder 210*a*, thereby determining the position of the return roller third timing pulley 211*a*. A return roller second timing belt 209*a* is stretched around the return roller second timing pulley 206*a* and the return roller third timing pulley 211*a*. The return roller second holder 210*a* includes a socket 210*ab* in which the shaft 204*ab* can fit.

The return roller 208*b* is formed of the same material as the return roller 208*a* and attached in the same manner as the return roller 208*a*. The drive is transmitted thereto via a return roller first timing pulley 205*b*, a return roller first holder 204*b*, a return roller second timing pulley 206*b*, a return roller first timing belt 207*b*, a return roller second timing belt 209*b*, a return roller second holder 210*b*, a return roller third timing pulley 211*b*, and the like. The shaft on the return roller 208*b* side has the same positional relationship as that of the return roller 208*a*, although not illustrated in FIGS. 4 and 5.

The drive shaft 212 is rotatably supported at a predetermined position of a frame 203 via bearings 215*a* and 215*b*. A drive pulley 216 is attached to an end of the drive shaft 212. A drive force from a drive motor 219 fixed to the frame 203 is input to the drive pulley 216. As the drive motor 219 is operated, the return rollers 208*a* and 208*b* are rotated. For the positioning of the return rollers 208*a* and 208*b*, the return roller second holders 210*a* and 210*b* are respectively screwed to screw holes 213*a* provided in a swing bracket 213.

Next, the displacement operation and the mechanism of the return rollers 208*a* and 208*b* are described. In this embodiment, as a cam 220 contacts the swing bracket 213, the swing bracket 213 swings, and the return roller second holders 210*a* and 210*b* secured to the swing bracket 213 are displaced. This operation moves the return rollers 208*a* and 208*b*, which are supported by the return roller first holders 204*a* and 204*b* coupled to the return roller second holders 210*a* and 210*b*.

Figure 5:
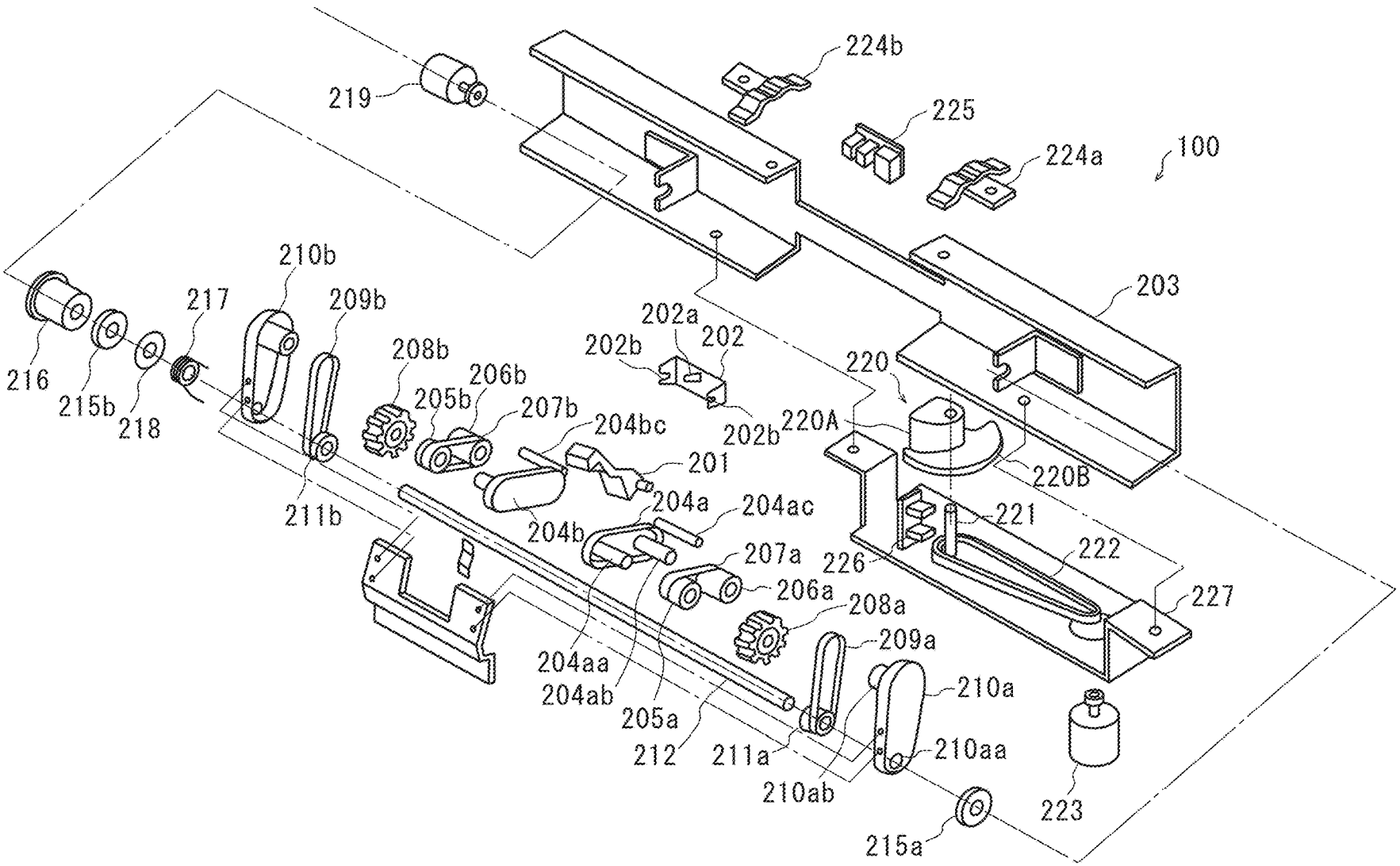
FIG. 5 is a schematic, exploded perspective view of the alignment member illustrated in FIG. 4.

The cam 220 includes a cam portion 220A located on the upper side and a feeler portion 220B located on the lower side (see FIG. 5). The cam 220 is rotatably supported by a pivot shaft 221 implanted in a holding bracket 227. A gear portion 220C (see FIG. 6B) is formed below the feeler portion 220B having a substantially semicircular shape. The gear portion 220C meshes with a swing timing belt 222. The swing timing belt 222 is coupled to a swing motor 223 that can rotate forward and backward. When the swing motor 223 rotates forward and backward, the cam 220 rotates, that is, pivots in the forward and reverse directions. In the vicinity of the feeler portion 220B, a sensor 226 is disposed. The sensor 226 detects the presence or absence of the feeler portion 220B, thereby detecting the position of the cam 220.

The swing bracket 213 is swung along the cam profile defined by the cam portion 220A of the cam 220. This movement is transmitted to the return rollers 208*a* and 208*b* via the return roller second holders 210*a* and 210*b* secured to the swing bracket 213, and the return rollers 208*a* and 208*b* swing. Meanwhile, positioning members 204*ac* and 204*bc* are integrated with the return roller first holders 204*a* and 204*b*, respectively. On the upper side of the frame 203, swinging holders 224*a* and 224*b* are attached. When the swinging bracket 213 swings, the positioning members 204*ac* and 204*bc* move along the top surfaces of the swinging holders 224*a* and 224*b* having wavy shapes. With this structure, the positioning of the return rollers 208*a* and 208*b* in the height direction are performed.

Further, in order to improve the ability of the swing bracket 213 to track the cam portion 220A, a spring 217 is attached to the drive shaft 212 and secured by a spring washer 218. The spring 217 actively biases the swing bracket 213 to the cam portion 220A.

Next, a description is given of a sheet surface detector that detects the height of the transfer sheet S or the sheet bundle S1 stacked on the output tray 78.

As the sheet surface detector, a sheet surface detection feeler 201 is used. The sheet surface detection feeler 201 is fitted with a bearing 202*b* of the sheet surface detection holder 202 fixed to the frame 203, and thus the position thereof is determined. The sheet surface detection holder 202 includes a contact portion 202*a*. The sheet surface detection feeler 201 is displaced upon contact with the transfer sheet S or the sheet bundle S1 on the output tray 78. When a sheet surface sensor 225 disposed at a sheet outlet 750 of the sheet post-processing apparatus 60 detects a part of the sheet surface detection feeler 201, the position is recognized as the sheet surface position. The sheet surface detection feeler 201 contacts a flat spring 214 fixed to the swing bracket 213, thereby following the movement of the swing bracket 213. Thus, the sheet surface detection feeler 201 is displaced by the action of the cam 220.

In the present embodiment, the linear speed of sheet ejection is reduced in the staple mode. The reduction in the sheet ejection speed causes the rear end of the sheet bundle S1 to land in the vicinity of the end fence 86. At this time, the return rollers 208*a* and 208*b* and the sheet surface detection feeler 201 are retracted, to prevent the sheet bundle S1 from contacting the return rollers 208*a* and 208*b* and the sheet surface detection feeler 201. Thus, the ability (neatness) of the sheet bundle S1 can improve.

Generally, in sheet post-processing apparatuses, due to the curved state or the flying state of the transfer sheet being ejected, the ejected transfer sheet may contact an already-stacked transfer sheet on the output tray. Then, the transfer sheet fails to slide down under the self-weight and does not reach a position to contact the alignment member. Accordingly, the alignment member is incapable of aligning the transfer sheet on the output tray. In addition, when the ejected transfer sheet contacts the already-stacked transfer sheet on the output tray, the already-stacked transfer sheet may be moved in the ejection direction. Then, the alignment is disturbed.

To avoid such an inconvenience, the alignment member can selectively occupy two positions, a home position where the alignment operation is not performed and an alignment position where the alignment operation is performed. According to the present embodiment, the alignment device 200 selectively occupy three positions including a retreat position located inward of the end fence than the home position, in addition to these two positions. These positions are described below.

Figure 6A:
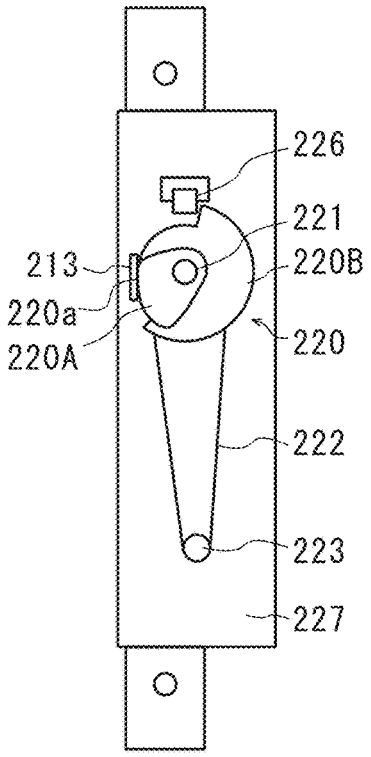
FIGS. 6A and 6B are schematic views illustrating a home position of a return roller according to an embodiment of the present disclosure.
Figure 6B:
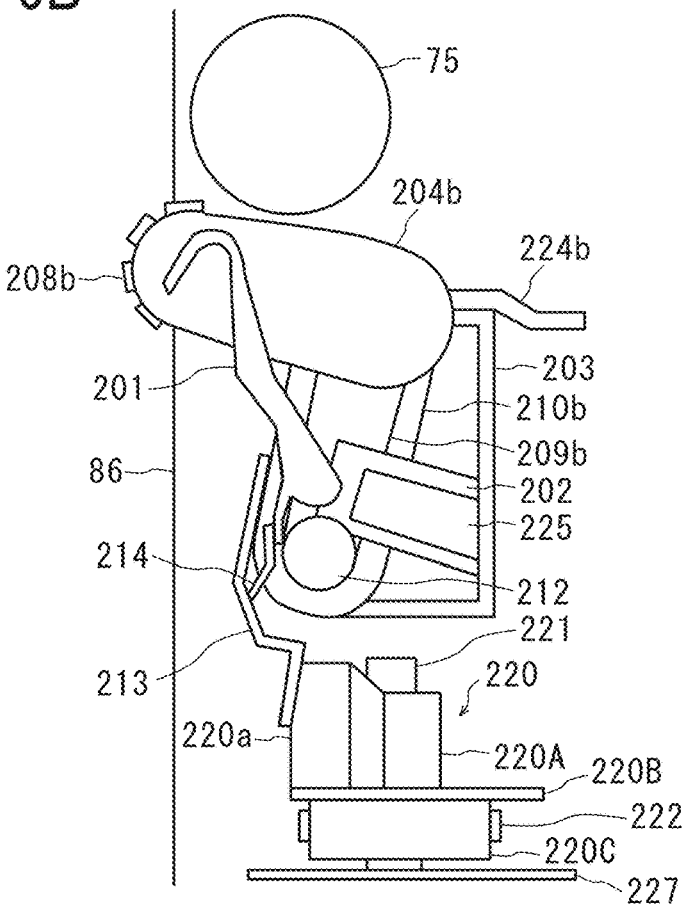

At the home positions, as illustrated in FIG. 6B, the return rollers 208*a* and 208*b* (only the return roller 208*b* is illustrated in FIG. 6) slightly protrude from the end fence 86 of the sheet post-processing apparatus 60 toward the output tray 78 (see FIG. 2). At the home position, a contact surface 220*a* of the cam portion 220A of the cam 220 is in contact with the swing bracket 213.

At the home position, a tip of the sheet surface detection feeler 201 also slightly protrudes from the end fence 86 toward the output tray 78. The sheet surface detection feeler 201 is positioned by the flat spring 214 in contact with the swing bracket 213.

As illustrated in FIG. 6A, the home position is such a position that the sensor 226 no longer detects the feeler portion 220B.

Figure 7A:
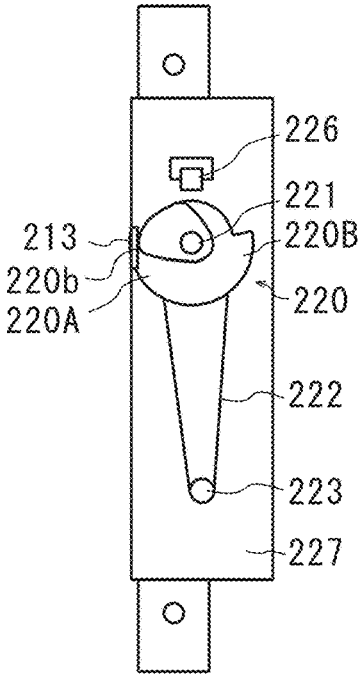
FIGS. 7A and 7B are schematic views illustrating a withdrawn position of the return roller illustrated in FIGS. 6A and 6B.

As illustrated in FIG. 7A, the withdrawn position is such a position that the cam 220 is rotated 65 degrees in the clockwise (CW) direction from the home position. This withdrawn position is characteristic to the present embodiment and different from the home position and the alignment position, at which the alignment member of the conventional sheet post-processing apparatus is set.

Figure 7B:
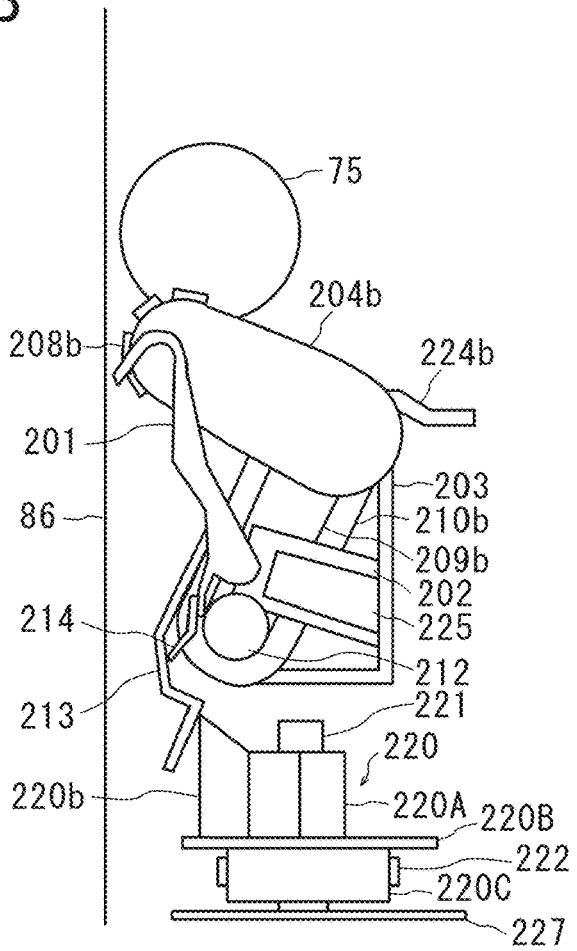

At the withdrawn position, as illustrated in FIG. 7B, the return rollers 208*a* and 208*b* (only the return roller 208*b* is illustrated in FIG. 7B) do not protrude from the end fence 86 toward the output tray 78 (see FIG. 2). The return rollers 208*a* and 208*b* are positioned inside the end fence 86. At the withdrawn position, the contact surface 220*b* of the cam portion 220A of the cam 220 contacts the swing bracket 213.

At the withdrawn position, the tip of the sheet surface detection feeler 201 is positioned inside the end fence 86, and the sheet surface detection feeler 201 is positioned by the flat spring 214 in contact with the swing bracket 213.

Figure 8A:
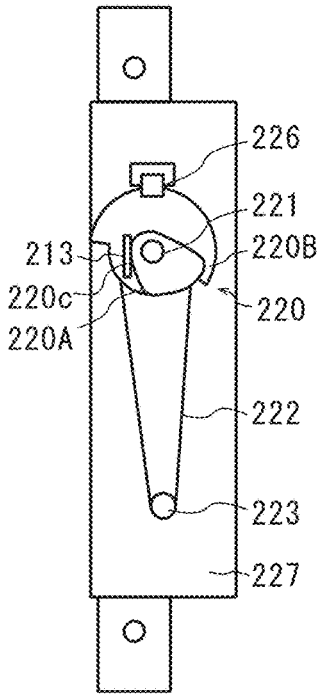
FIGS. 8A and 8B are schematic views illustrating an alignment position of the return roller.

As illustrated in FIG. 8A, the alignment position is such a position that the cam 220 is rotated 95 degrees in the counterclockwise (CCW) direction from the home position.

Figure 8B:
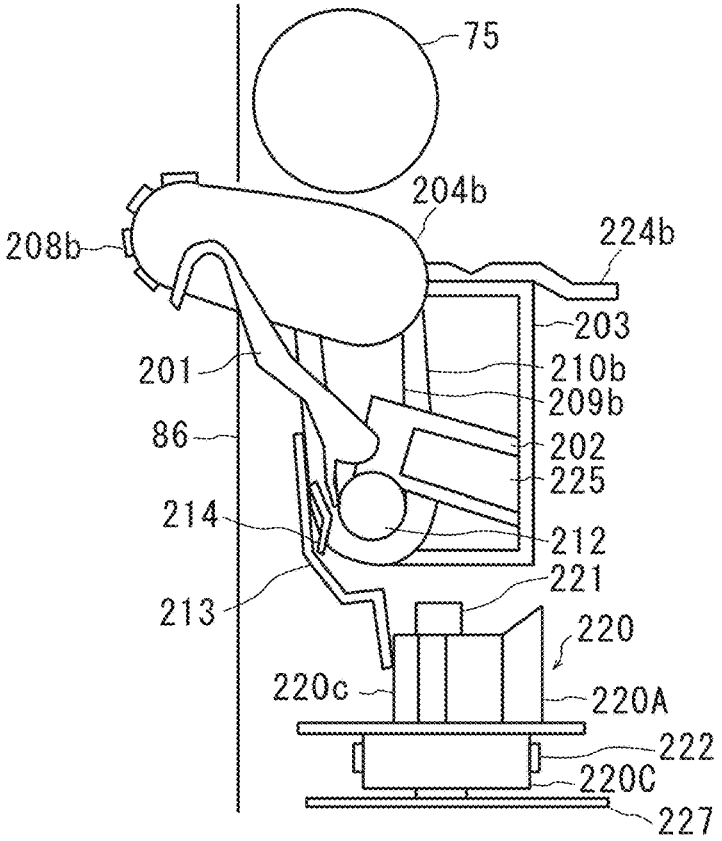

At the alignment position, as illustrated in FIG. 8B, the return rollers 208*a* and 208*b* (only the return roller 208*b* is illustrated) protrude from the end fence 86 toward the output tray 78 to be able to contact the transfer sheet S or the sheet bundle S1 on the output tray 78. At the alignment position, in the cam 220, the contact surface 220*c* of the cam portion 220A is in contact with the swing bracket 213.

At the alignment position, the tip of the sheet surface detection feeler 201 protrudes from the end fence 86 toward the output tray 78. The sheet surface detection feeler 201 is released from the contact with the flat spring 214 and positioned by contact with the contact portion 202*a* (see FIG. 5).

Figure 9:
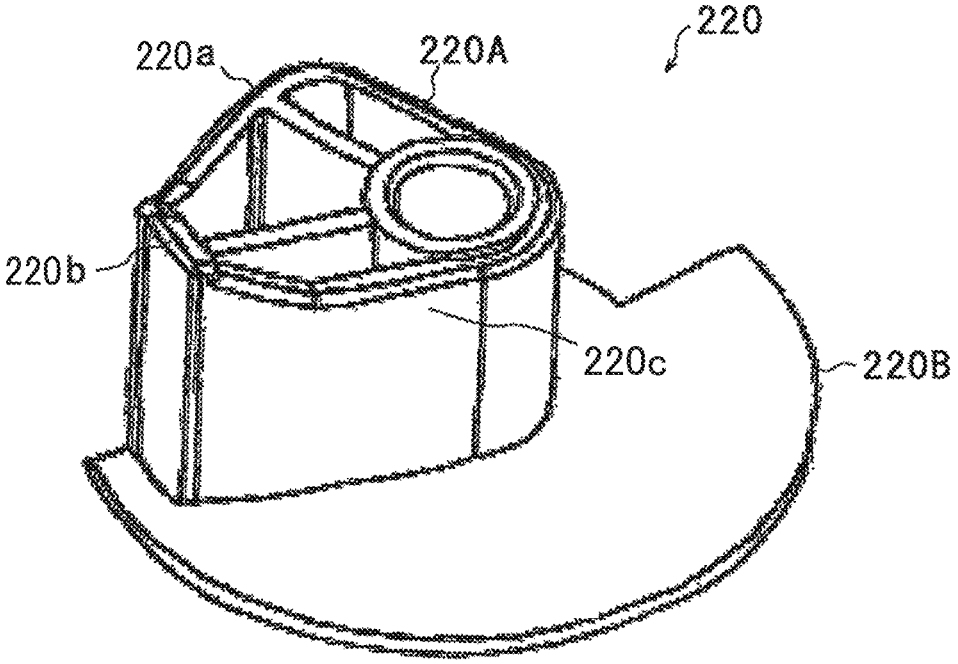
FIG. 9 is a schematic perspective view illustrating a cam according to an embodiment of the present disclosure.

The swing bracket 213 is coupled to and interlocked with the return rollers 208*a* and 208*b* and the sheet surface detection feeler 201. The cam profile of the cam portion 220A of the cam 220 is designed to displace the swing bracket so that the return rollers 208*a* and 208*b* and the sheet surface detection feeler 201 occupy the home position, the withdrawn position, and the alignment position described above. Specifically, the cam portion 220A is shaped so that the contact surface (220*a*, 220*b*, or 220*c*) thereof is closest to the swing bracket 213 at the alignment position, farthest from the swing bracket 213 at the withdrawn position, and positioned therebetween at the home position. FIG. 9 illustrates an example of the cam 220 including the cam portion 220A shaped to satisfy such conditions.

Based on the above-described configuration, the operation of the sheet post-processing apparatus 60 in the first embodiment is described below.

Figure 10:
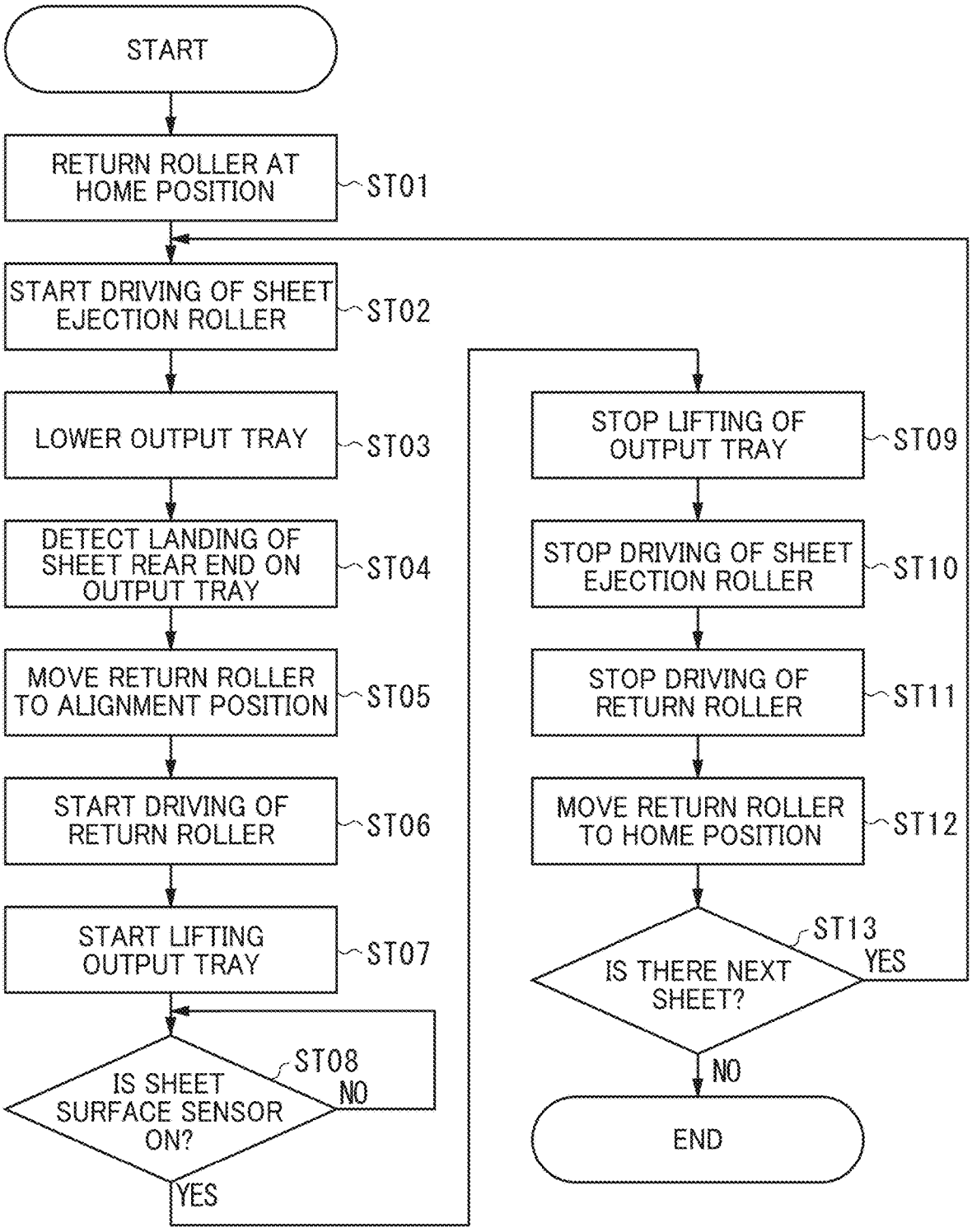
FIG. 10 is a flowchart illustrating an operation in a sheet ejection mode according to an embodiment of the present disclosure.

First, a description is given of the operation in the sheet ejection mode, represented by the normal mode, in which the transfer sheets S are ejected one by one onto the output tray 78, referring to the flowchart illustrated in FIG. 10.

In an initial state, the return rollers 208*a* and 208*b* are at the home positions illustrated in FIG. 6B (ST01). In response to detection of the conveyed sheet by the sheet sensor 73, the sheet ejection roller 75 is rotated (ST02). The transfer sheet S conveyed by the intermediate conveyance roller pair 74 is conveyed by the sheet ejection roller 75 and the driven roller 76 while being held therebetween. At this time, the tray lift 72 is actuated and lowers the output tray 78 by a predetermined amount (ST03).

Then, a sensor provided on the output tray 78 detects landing, on the output tray 78, of the rear end of the transfer sheet S sandwiched and conveyed by the sheet ejection roller 75 and the driven roller 76 (ST04). Until then, the cam 220 occupies the position illustrated in FIG. 6A (home position). After elapse of a predetermined time from the detection of the landing, the swing motor 223 is actuated, and the cam 220 rotates counterclockwise by 95 degrees and becomes the state illustrated in FIG. 8A. The return rollers 208*a* and 208*b* are displaced to the alignment positions illustrated in FIG. 8B (ST05).

When the return rollers 208*a* and 208*b* are positioned at the alignment positions, the drive motor 219 starts rotating the return rollers 208*a* and 208*b* (ST06). Then, the tray lift 72 starts lifting the output tray 78 (ST07). As the sheet surface detection feeler 201 is displaced by the contact with the transfer sheet S placed on the output tray 78, the sheet surface sensor 225 detects the sheet surface detection feeler 201 and turns on (ST08). In response to the detection, the tray lift 72 stops lifting the output tray 78 (ST09).

When the output tray 78 is stopped at a predetermined position and the return rollers 208*a* and 208*b* contact the transfer sheet S on the output tray 78, the transfer sheet S placed on the output tray 78 is moved to the end fence 86 by the rotation of the return rollers 208*a* and 208*b*. As the rear end of the transfer sheet S in the ejection direction contacts the end fence 86, the transfer sheet S is aligned. After elapse of a predetermined time, the sheet ejection roller 75 is stopped (ST10), and the drive motor 219 is stopped, thus stopping the rotation of the return rollers 208*a* and 208*b* (ST11).

After the rotation is stopped, the swing motor 223 is actuated to rotate the cam 220 from the position illustrated in FIG. 8A clockwise by 95 degrees to the position illustrated in FIG. 6A. Thus, the return rollers 208*a* and 208*b* are again positioned at the home positions illustrated in FIG. 6B (ST12). Then, based on the signal from the sheet sensor 73, the controller determines whether or not a next transfer sheet S is being conveyed (ST13). In response to a determination that the next transfer sheet S is being conveyed, the process returns to step ST02 and a series of operations is again performed. In response to a determination that the next transfer sheet S is not conveyed, the sheet ejection mode completes.

Note that the predetermined amount or predetermined time are stored in a memory, for example, by a manufacturer based on empirical data.

According to the above-described sheet ejection mode, similar to the conventional sheet post-processing apparatus, the return rollers 208*a* and 208*b* are at the home positions when the transfer sheet S is ejected by the sheet ejection roller 75 onto the output tray 78. Accordingly, in a case where the transfer sheet S is not fully ejected onto the output tray 78 by the sheet ejection roller 75, the return rollers 208*a* and 208*b* are rotated to eject the rear end of the transfer sheet S onto the output tray 78 with the return rollers 208*a* and 208*b*. Accordingly, the occurrence of defective sheet conveyance can be prevented.

Figure 11:
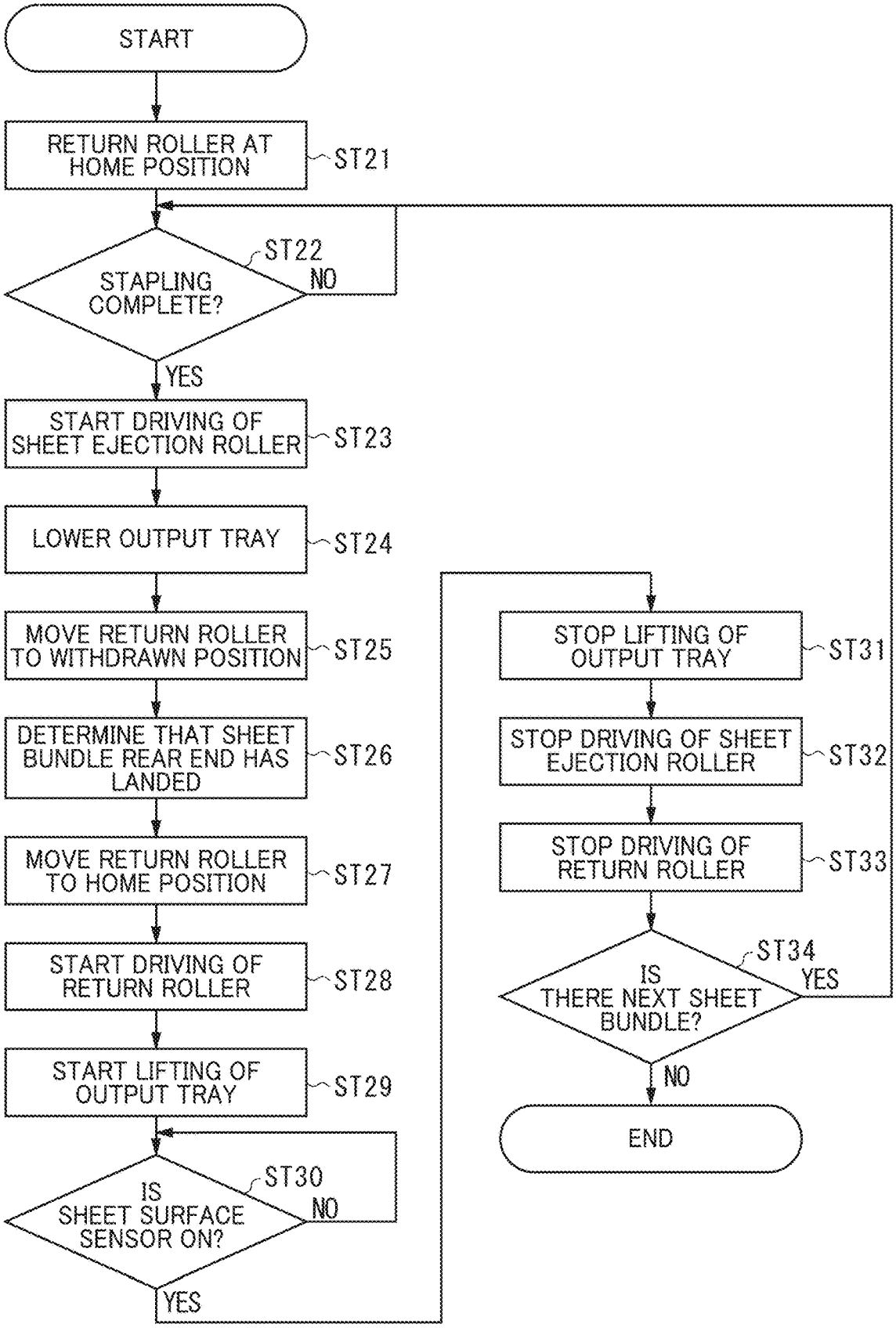
FIG. 11 is a flowchart illustrating an operation in a sheet-bundle ejection mode according to a first embodiment of the present disclosure.

Next, a description is given of the operation in the sheet-bundle ejection mode, represented by the staple mode, in which multiple transfer sheets S are ejected in the unit of a bundle (a sheet bundle S1) onto the output tray 78, referring to the flowchart illustrated in FIG. 11.

In the initial state, the return rollers 208*a* and 208*b* are at the home positions (ST21). The controller determines whether or not the stapling operation by the stapler 85 is completed (ST22). In response to a determination that the staple operation is completed, the sheet ejection roller 75 is rotated (ST23). The sheet bundle S1 that has been stapled and placed on the staple tray 80 is sandwiched between the sheet ejection roller 75 and the driven roller 76 and conveyed. At this time, the tray lift 72 lowers the output tray 78 by a predetermined amount (ST24).

At the same time as the output tray 78 starts descending, the swing motor 223 is actuated, and the cam 220 rotates from the position illustrated in FIG. 6A clockwise by 65 degrees to the position illustrated in FIG. 7A. Then, the return rollers 208*a* and 208*b* are displaced to the withdrawn positions illustrated in FIG. 7B (ST25). This displacement operation is performed in a period to when the rear end of the sheet bundle S1 conveyed by the sheet ejection roller 75 exits the sheet ejection roller 75.

After a predetermined time has elapsed, the controller determines that the rear end of the sheet bundle S1 has landed on the output tray 78 (ST26). Then, the swing motor 223 is activated, and the cam 220 rotates from the position illustrated in FIG. 7A counterclockwise by 65 degrees to the position illustrated in FIG. 6A. Thus, the return rollers 208*a* and 208*b* are displaced to the home positions illustrated in FIG. 6B (ST27).

The sheet bundle S1 ejected onto the output tray 78 is heavier than one transfer sheet S. Accordingly, in the sheet-bundle ejection mode, the ejected sheet bundle S1 moves by the weight thereof to the end fence 86 along the inclination of output tray 78. That is, without moving the return rollers 208*a* and 208*b* to the alignment positions to actively move the sheet bundle S1, the rear end of the sheet bundle S1 can be desirably aligned.

When the return rollers 208*a* and 208*b* are positioned at the home positions, the drive motor 219 is actuated to rotate the return rollers 208*a* and 208*b* (ST28). If the rear end of the sheet bundle S1 ejected from the sheet ejection roller 75 remains, the rear end is ejected onto the output tray 78 by the rotation of the return rollers 208*a* and 208*b*.

Then, the tray lift 72 starts lifting the output tray 78 (ST29). As the sheet surface detection feeler 201 is displaced by the contact with the sheet bundle S1 placed on the output tray 78, the sheet surface sensor 225 detects the sheet surface detection feeler 201 and turns on (ST30). In response to the detection, the tray lift 72 stops lifting the output tray 78 (ST31).

After elapse of a predetermined time from when the output tray 78 is stopped at the predetermined position, the sheet ejection roller 75 is stopped (ST32), and the drive motor 219 is stopped, thus stopping the rotation of the return rollers 208*a* and 208*b* (ST33). Then, based on the signal from the sheet sensor 73, the controller determines whether or not a next sheet bundle S1 is being conveyed (ST34). In response to a determination that the next sheet bundle S1 is being conveyed, the process returns to step ST22 and a series of operations is again performed. In response to a determination that the next sheet bundle S1 is not conveyed, the sheet-bundle ejection mode completes.

In this sheet-bundle ejection mode, when the sheet ejection roller 75 ejects the sheet bundle S1 onto the output tray 78, the return rollers 208*a* and 208*b* are withdrawn from the home positions to the withdrawn positions. Therefore, when the sheet bundle S1 lands on the output tray 78, the rear end of the sheet bundle S1 is prevented from interfering with the return rollers 208*a* and 208*b*. Thus, alignment of the sheet bundle S1 on the output tray 78 is not disturbed.

In the first embodiment, the return rollers 208*a* and 208*b* are selectively set at either the home positions or the withdrawn positions, without being set at the alignment positions. Therefore, the time required for the displacement of the return rollers 208*a* and 208*b* can be shortened, and the image forming cycle can be shortened.

As described above, in the sheet post-processing apparatus 60 according to the present embodiment, the alignment device 200 are selectively set at the three positions: the alignment position, the withdrawn position, and the home position. Therefore, in the sheet ejection mode in which the transfer sheets S are ejected to the output tray 78 one by one, the return rollers 208*a* and 208*b* ejects, onto the output tray 78, the rear end of the transfer sheet S that has failed to reach the output tray 78, thereby preventing the occurrence of defective sheet conveyance. In the sheet-bundle ejection mode in which a plurality of transfer sheets S is ejected to the output tray 78 in the unit of one bundle (the sheet bundle S1), the return rollers 208*a* and 208*b* are prevented from interfering with the rear end of the sheet bundle S1 when the sheet bundle S1 lands on the output tray 78. Thus, alignment of the sheet bundle S1 on the output tray 78 is not disturbed.

Figure 12A:
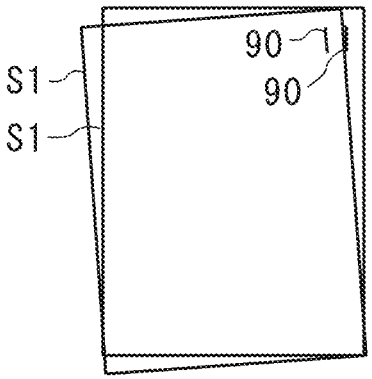
FIGS. 12A and 12B are schematic diagrams illustrating a behavior of a sheet bundle in the first embodiment of the present disclosure.
Figure 12B:
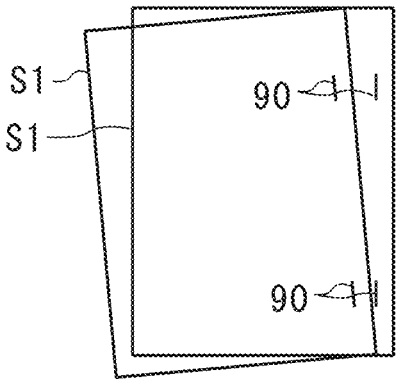

In the first embodiment described above, the return rollers 208*a* and 208*b* selectively occupy one of two positions, the home position and the withdrawn position, in the sheet-bundle ejection mode. However, due to the size of the sheet bundle S1 and ejection speed, the ejected sheet bundle S1 may fly farther than the target position. In such a case, when the sheet bundle S1 moves to the end fence 86 side by the weight thereof, as illustrated in FIGS. 12A and 12B, there is a possibility that the end of the sheet bundle S1 is caught on a staple 90 of an already-stacked sheet bundle S1 on the output tray 78, and the alignment is deteriorated.

Figure 13:
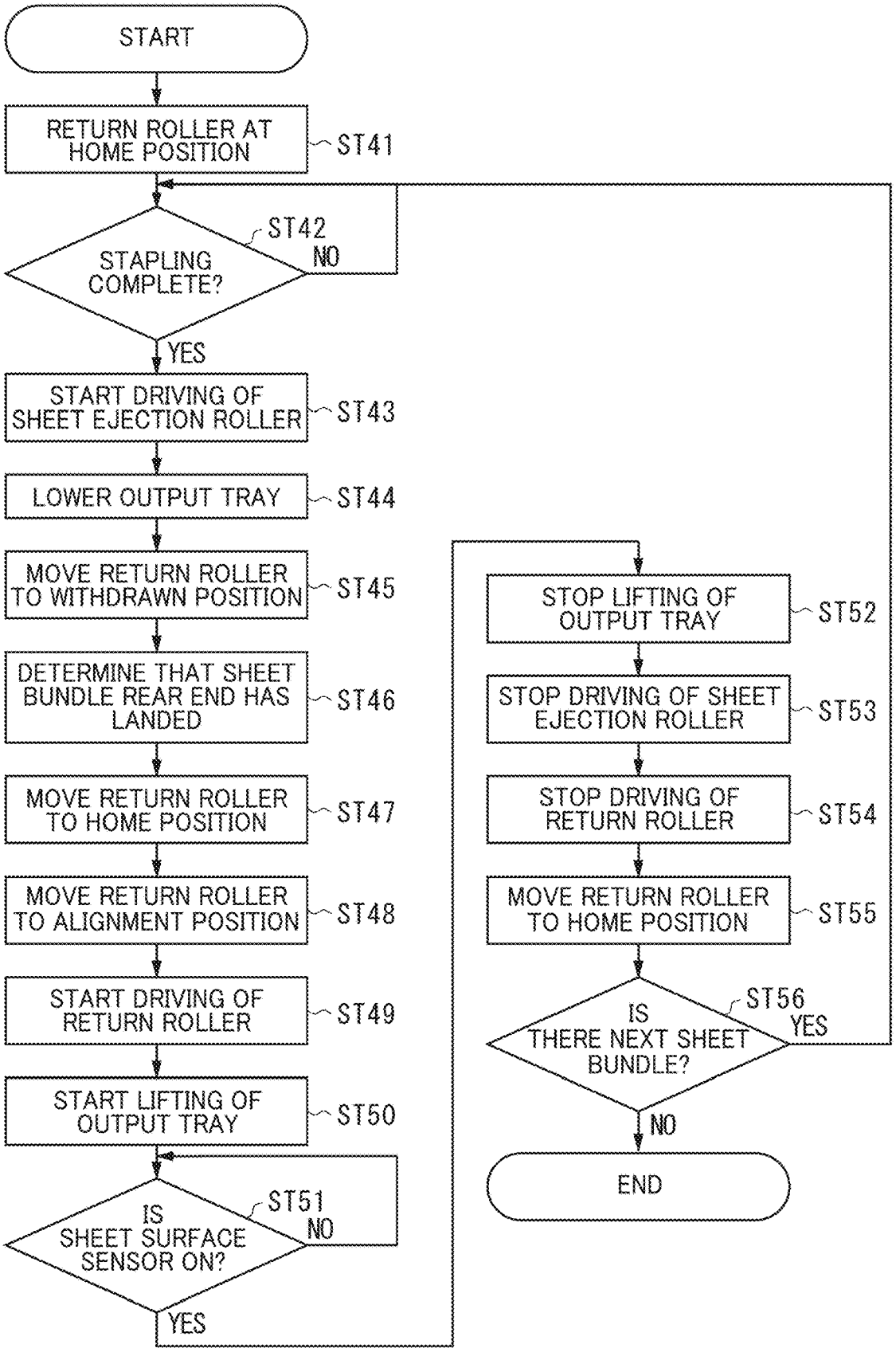
FIG. 13 is a flowchart illustrating an operation in a sheet-bundle ejection mode according to a second embodiment of the present disclosure.

In view of the foregoing, a second embodiment is described below. A description is given of an operation in the sheet-bundle ejection mode in the second embodiment, with reference to the flowchart illustrated in FIG. 13. The operation in the sheet ejection mode in the second embodiment is the same as that in the first embodiment.

In the initial state, the return rollers 208*a* and 208*b* are at the home positions (ST41). The controller determines whether or not the stapling operation by the stapler 85 is completed (ST42). In response to a determination that the staple operation is completed, the sheet ejection roller 75 is rotated (ST43). The sheet bundle S1 that has been stapled and placed on the staple tray 80 is sandwiched between the sheet ejection roller 75 and the driven roller 76 and conveyed. At this time, the tray lift 72 lowers the output tray 78 by a predetermined amount (ST44).

At the same time as the output tray 78 starts descending, the swing motor 223 is actuated, and the cam 220 rotates from the position illustrated in FIG. 6A clockwise by 65 degrees to the position illustrated in FIG. 7A. Then, the return rollers 208*a* and 208*b* are displaced to the withdrawn positions illustrated in FIG. 7B (ST45). This displacement operation is performed in a period to when the rear end of the sheet bundle S1 conveyed by the sheet ejection roller 75 exits the sheet ejection roller 75.

After a predetermined time has elapsed, the controller determines that the rear end of the sheet bundle S1 has landed on the output tray 78 (ST46). Then, the swing motor 223 is activated, and the cam 220 rotates from the position illustrated in FIG. 7A counterclockwise by 65 degrees to the position illustrated in FIG. 6A. Thus, the return rollers 208*a* and 208*b* are displaced to the home positions illustrated in FIG. 6B (ST47).

Until then, the cam 220 occupies the position illustrated in FIG. 6A (home position). When the return rollers 208*a* and 208*b* are positioned at the home positions which are the initial positions, the swing motor 223 continues driving, and the cam 220 rotates counterclockwise by 95 degrees and becomes the state illustrated in FIG. 8A. The return rollers 208*a* and 208*b* are displaced to the alignment positions illustrated in FIG. 8B (ST48).

When the return rollers 208*a* and 208*b* are positioned at the alignment positions, the drive motor 219 starts rotating the return rollers 208*a* and 208*b* (ST49). Then, the tray lift 72 starts lifting the output tray 78 (ST50). As the sheet surface detection feeler 201 is displaced by the contact with the sheet bundle S1 placed on the output tray 78, the sheet surface sensor 225 detects the sheet surface detection feeler 201 and turns on (ST51). In response to the detection, the tray lift 72 stops lifting the output tray 78 (ST52).

When the output tray 78 is stopped at a predetermined position and the return rollers 208*a* and 208*b* contact the sheet bundle S1 on the output tray 78, the sheet bundle S1 placed on the output tray 78 is moved to the end fence 86 by the rotation of the return rollers 208*a* and 208*b*. As the rear end of the sheet bundle S1 in the ejection direction contacts the end fence 86, the sheet bundle S1 is aligned. After elapse of a predetermined time, the sheet ejection roller 75 is stopped (ST53), and the drive motor 219 is stopped, thus stopping the rotation of the return rollers 208*a* and 208*b* (ST54).

After the rotation is stopped, the swing motor 223 is actuated to rotate the cam 220 from the position illustrated in FIG. 8A clockwise by 95 degrees to the position illustrated in FIG. 6A. Thus, the return rollers 208*a* and 208*b* are again positioned at the home positions illustrated in FIG. 6B (ST55). Then, based on the signal from the sheet sensor 73, the controller determines whether or not a next transfer sheet S is being conveyed and a next sheet bundle S1 is to be conveyed (ST56). In response to a determination that the next sheet bundle S1 is being conveyed, the process returns to step ST42 and a series of operations is again performed. In response to a determination that the next sheet bundle S1 is not conveyed, the sheet-bundle ejection mode completes.

The second embodiment provides the following advantage, in addition to the effects attained by the sheet-bundle ejection mode in the first embodiment. While contacting the sheet bundle S1 ejected and stacked on the output tray 78, the return rollers 208*a* and 208*b* at the alignment positions rotate, thereby aligning the rear end of the sheet bundle S1 to contact the end fence 86 (alignment operation). Therefore, the alignment of the sheet bundle S1 can be corrected even if the sheet bundle S1 lands at a deviated position on the output tray 78. Thus, alignment of the sheet bundle S1 on the output tray 78 can be better secured.

In each of the embodiments described above, the return rollers 208*a* and 208*b* are not displaced to the withdrawn positions in the sheet ejection mode from the following reason. If the return rollers 208*a* and 208*b* are displaced to the withdrawn positions, which are farther from the output tray 78 than the home positions, the amount of displacement of the return rollers 208*a* and 208*b* is larger. Accordingly, increasing the sheet conveyance speed is difficult, and productivity deteriorates.

The return rollers 208*a* and 208*b* being at the home positions protrude from the end fence 86 toward the output tray 78. As described above, there is a case where the sheet ejection roller 75 fails to fully eject the rear end of the transfer sheet S from the sheet post-processing apparatus 60. Therefore, the return rollers 208*a* and 208*b* are disposed as described above to eject the rear end of the transfer sheet S remaining in the sheet post-processing apparatus 60. However, in this configuration, there is a possibility that the rear end of the transfer sheet S interferes with the return rollers 208*a* and 208*b*, and the alignment of the transfer sheet S is disturbed.

The rear end of the transfer sheet S to be ejected to the output tray 78 may remain in the sheet post-processing apparatus 60 as described above in a case where the size is large exceeding the A4 size and the retentivity (the property to retain a particular shape once applied, such as curvature of paper) of the transfer sheet S is weak. Therefore, the sheet post-processing apparatus 60 can further include a sheet size detector to detect the size of the transfer sheet S. When the size is a reference size (e.g., A4) or smaller, the return rollers 208*a* and 208*b* are displaced to the withdrawn positions, to prevent the rear end of the transfer sheet S from interfering with the return rollers 208*a* and 208*b*. Thus, the alignment of the transfer sheet S on the output tray 78 can be secured.

In this case, the sheet size detector is disposed in the sheet feeder 4 or other locations where the transfer sheet S passes. For example, the sheet size detector is a sheet sensor 45 disposed above the conveyance member 43 in FIG. 1, the entry sensor 61, or the sheet sensor 73. In the flowchart illustrated in FIG. 10, the return rollers 208*a* and 208*b* are moved to the withdrawn positions between steps ST03 and ST04 and are moved back to the home positions between steps ST04 and ST05. Accordingly, the effect mentioned above can be acquired.

In the above-described embodiments and variations, the color copier 1 is described as an example of an image forming apparatus, but the image forming apparatus is not limited thereto. The present disclosure is adoptable to a printer, a facsimile machine, a multifunction peripheral (MFP), and monochrome types thereof. In the above-described embodiments, an image is formed on the transfer sheet S as a recording medium. The transfer sheet S can be thick paper, a postcard, an envelope, plain paper, thin paper, coated paper (e.g., art paper), tracing paper, an overhead projector (OHP) transparency sheet (or OHP film), a resin film, and any other sheet-shaped material to bear an image and can be stapled.

Some embodiments of the present disclosure has been described above. However, embodiments of the present disclosure are not limited to the above-described embodiments, and various modifications and changes can be made within a range of the gist of the present disclosure recited in the scope of claims.

The advantages achieved by the embodiments described above are examples and therefore are not limited to those described above.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A sheet post-processing apparatus comprising:

an output tray on which one or more sheets ejected from a sheet outlet is stacked;

a wall disposed upstream from the output tray in a sheet ejection direction; and an alignment member configured to contact and move the sheets on the output tray, to bring a rear end of the sheets in the sheet ejection direction into contact with the wall for alignment, the alignment member configured to:

align the sheets when the sheets are joined in a sheet bundle by moving between a home position and a withdrawn position or between the home position, the withdrawn position and an alignment position, and align the sheets when the sheets are not joined in the sheet bundle by moving between the home position and the alignment position, wherein in the alignment position the alignment member protrudes beyond the wall toward the output tray to contact the sheets on the output tray, in the withdrawn position the alignment member is inward of the wall, and in the home position the alignment member is between the alignment position and the withdrawn position.

2. The sheet post-processing apparatus according to claim 1, further comprising:

a sheet surface detector configured to detect a height of the sheets stacked on the output tray, the sheet surface detector configured to move to a first position corresponding to the alignment position, a second position corresponding to the withdrawn position, and a third position corresponding to the home position.

3. The sheet post-processing apparatus according to claim 2, wherein the alignment member and the sheet surface detector are interlocked with each other.

4. The sheet post-processing apparatus according to claim 1, further comprising:

a cam mechanism configured to move the alignment member to the alignment position, the withdrawn position, and the home position.

5. The sheet post-processing apparatus according to claim 1, further comprising:

circuitry configured to:

control the sheet post-processing apparatus to operate in selected one of a sheet ejection mode for ejecting the sheets one by one and a sheet-bundle ejection mode for ejecting the sheet bundle including the sheets; and move the alignment member to the withdrawn position when the sheet-bundle ejection mode is selected.

6. The sheet post-processing apparatus according to claim 1, further comprising:

a sheet size detector configured to detect a size of the sheets, and circuitry configured to move the alignment member to the withdrawn position in response to a detection result that the size of the sheets detected by the sheet size detector is a reference size or smaller.

7. An image forming system comprising:

an image forming apparatus configured to form an image on a sheet; and the sheet post-processing apparatus according to claim 1, configured to stack the sheet ejected from the image forming apparatus.

8. The sheet post-processing apparatus according to claim 1, wherein, the alignment member is switched from the home position to the withdrawn position prior to an end of the sheet bundle closest to the wall landing in the output tray.

9. The sheet post-processing apparatus according to claim 1, wherein the output tray is configured to move vertically.

10. The sheet post-processing apparatus according to claim 1, wherein, when the sheets are joined in the sheet bundle, the output tray is configured to lower prior to switching the alignment member from the home position to the withdrawn position.

11. A sheet post-processing apparatus comprising:

an output tray on which a sheet ejected from a sheet outlet is stacked;

a wall disposed upstream from the output tray in a sheet ejection direction;

an alignment member configured to contact and move the sheet on the output tray, to bring a rear end of the sheet in the sheet ejection direction into contact with the wall for alignment, the alignment member configured to be selectively set at three positions of:

an alignment position protruding beyond the wall toward the output tray to contact the sheet on the output tray, a withdrawn position inward of the wall, and a home position between the alignment position and the withdrawn position; and a sheet surface detector configured to detect a height of the sheet stacked on the output tray, the sheet surface detector configured to move to a first position corresponding to the alignment position, a second position corresponding to the withdrawn position, and a third position corresponding to the home position.

12. The sheet post-processing apparatus according to claim 11, wherein the alignment member and the sheet surface detector are interlocked with each other.

13. The sheet post-processing apparatus according to claim 11, further comprising:

a cam mechanism configured to move the alignment member to the alignment position, the withdrawn position, and the home position.

14. The sheet post-processing apparatus according to claim 11, further comprising:

circuitry configured to:

control the sheet post-processing apparatus to operate in selected one of a sheet ejection mode for ejecting the sheet one by one and a sheet-bundle ejection mode for ejecting a sheet bundle including a plurality of sheets; and move the alignment member to the withdrawn position when the sheet-bundle ejection mode is selected.

15. The sheet post-processing apparatus according to claim 11, further comprising:

a sheet size detector configured to detect a size of the sheet, and circuitry configured to move the alignment member to the withdrawn position in response to a detection result that the size of the sheet detected by the sheet size detector is a reference size or smaller.

16. An image forming system comprising:

an image forming apparatus configured to form an image on a sheet; and the sheet post-processing apparatus according to claim 11, configured to stack the sheet ejected from the image forming apparatus.

17. The sheet post-processing apparatus according to claim 11, wherein, the alignment member is switched from the home position to the withdrawn position prior to an end of a sheet bundle closest to the wall landing in the output tray.

18. The sheet post-processing apparatus according to claim 11, wherein the output tray is configured to move vertically.

19. The sheet post-processing apparatus according to claim 11, wherein, when the sheet is joined in a sheet bundle, the output tray is configured to lower prior to switching the alignment member from the home position to the withdrawn position.

* * * * *